US007363918B2

(12) United States Patent
Majima

(10) Patent No.: US 7,363,918 B2
(45) Date of Patent: Apr. 29, 2008

(54) CONTROLLER OF PRESSURE ACCUMULATION FUEL SYSTEM

(75) Inventor: Yoshihiro Majima, Inuyama (JP)

(73) Assignee: Denso Corporation, Kariya, Aichi-pref. (JP)

( * ) Notice: Subject to any disclaimer, the term of this patent is extended or adjusted under 35 U.S.C. 154(b) by 17 days.

(21) Appl. No.: 11/593,017

(22) Filed: Nov. 6, 2006

(65) Prior Publication Data

US 2007/0101972 A1 May 10, 2007

(30) Foreign Application Priority Data

Nov. 4, 2005 (JP) ..... 2005-321333

(51) Int. Cl.
*F02M 37/00* (2006.01)
*F02M 37/20* (2006.01)

(52) U.S. Cl. ..... 123/514; 123/516

(58) Field of Classification Search ..... 123/514, 123/516, 464, 467

See application file for complete search history.

(56) References Cited

U.S. PATENT DOCUMENTS 4,385,615 A * 5/1983 Keane ..... 123/514
4,989,572 A * 2/1991 Giacomazzi et al. ..... 123/514
5,197,443 A * 3/1993 Hodgkins ..... 123/514
5,431,143 A * 7/1995 Brown ..... 123/514
5,456,235 A * 10/1995 Porter ..... 123/509
5,809,975 A * 9/1998 Tuckey et al. ..... 123/509
6,257,208 B1 * 7/2001 Harvey ..... 123/516
6,446,612 B1 * 9/2002 Hankins et al. ..... 123/514
6,647,968 B1 * 11/2003 Hankins et al. ..... 123/514

FOREIGN PATENT DOCUMENTS

JP 10-54267 2/1998

* cited by examiner

*Primary Examiner*—Thomas Moulis
(74) *Attorney, Agent, or Firm*—Nixon & Vanderhye P.C.

(57) ABSTRACT

A common rail fuel injection system has a fuel pump, a common rail, and an injector. The injector injects high-pressure fuel supplied from the common rail into an engine and leaks part of the high-pressure fuel. An electronic control unit (ECU) restricts a heat amount of the leak fuel of the injector based on a remaining amount of the fuel in a fuel tank. At that time, a target value of the fuel pressure in the common rail is changed to a lower value and the restriction of the fuel pressure is performed with the changed target value. Thus, decrease in generation torque of the engine against intension of a driver can be inhibited while protecting components such as the fuel injection valve.

11 Claims, 7 Drawing Sheets

CONTROLLER OF PRESSURE ACCUMULATION FUEL SYSTEM

CROSS REFERENCE TO RELATED APPLICATION

This application is based on and incorporates herein by reference Japanese Patent Application No. 2005-321333 filed on Nov. 4, 2005.

BACKGROUND OF THE INVENTION

1. Field of the Invention

The present invention relates to a controller of a pressure accumulation fuel system.

2. Description of Related Art

A common rail fuel injection system is practically used as a fuel injection system of a diesel engine. The common rail fuel injection system accumulates fuel in a common rail at high pressure corresponding to fuel injection pressure and supplies the accumulated high-pressure fuel to the engine through a fuel injection valve. In the common rail fuel injection system, the fuel pressure in the common rail decreases if the fuel injection valve performs the fuel injection. At that time, the fuel supply pump supplies the high-pressure fuel to the common rail to maintain the inside of the common rail at a predetermined high-pressure state.

In the high-pressure fuel system using the common rail and the like, there is a possibility that fuel temperature increases in accordance with a change in an engine operation state and the like. A failure can be caused if the fuel temperature increases over allowable temperature of various components. Therefore, a countermeasure is necessary. However, addition of a cooler for inhibiting the increase of the fuel temperature is inadvisable.

A technology of sensing the fuel temperature and of preventing the fuel temperature from exceeding a predetermined value by restricting a fuel injection amount of the fuel injection valve, the discharge amount of the fuel supply pump, the fuel pressure in the common rail and the like is proposed, for example, as described in JP-A-H10-54267. The technology restricts the fuel injection amount, the fuel pressure or the like simply based on the fuel temperature. Therefore, there is a possibility that the fuel injection amount is restricted and torque is reduced when high torque is required by a driver. In such a case, the requirement of the driver cannot be satisfied, deteriorating drivability of a vehicle.

The fuel injection valve employs a structure of a two-way electromagnetic valve or a three-way electromagnetic valve. The high-pressure fuel is supplied or discharged (leaked) in accordance with opening operation and closing operation of the two-way electromagnetic valve or the three-way electromagnetic valve. A valve member moves in accordance with the leakage of the high-pressure fuel. Thus, the fuel injection is performed. In such a structure, there is a possibility that the fuel temperature rapidly increases in the leaking period of the high-pressure fuel and the fuel injection valve is damaged due to the increase of the fuel temperature.

SUMMARY OF THE INVENTION

It is an object of the present invention to provide a controller of a pressure accumulation fuel system capable of protecting components such as a fuel injection valve and inhibiting decrease of engine torque against intention of a driver.

According to an aspect of the present invention, a pressure accumulation fuel system pressure-feeds high-pressure fuel with a fuel supply pump and accumulates the high-pressure fuel in a pressure accumulation vessel. A fuel injection valve injects the high-pressure fuel in the pressure accumulation vessel into an engine. At that time, the fuel injection valve leaks part of the high-pressure fuel, which is returned to a fuel tank. In this structure, the high-pressure fuel is rapidly depressurized during the fuel leak at the fuel injection valve. Accordingly, temperature of the leak fuel rapidly increases. Generally, a two-way valve or a three-way valve is used as the fuel injection valve. The fuel injection valve leaks the high-pressure fuel through operation of a leak fuel control section provided by the two-way valve or the three-way valve. The fuel injection valve operates a valve member to inject the fuel in accordance with the fuel leak.

The pressure accumulation fuel system according to the aspect of the present invention senses a fuel remaining amount in the fuel tank and restricts the heat amount of the leak fuel at the fuel injection valve based on the sensed fuel remaining amount. The heat amount of the leak fuel should be preferably set smaller as the fuel remaining amount decreases. During the operation of the engine, the fuel temperature increases in accordance with the fuel leak in the fuel injection valve and the fuel, temperature of which is increased, is returned to the fuel tank. The fuel is pressure-fed to the pressure accumulation vessel again by the fuel supply pump and is supplied to the fuel injection valve again. In this case, the fuel temperature in the whole system (for example, the fuel temperature in the fuel tank) increases due to the circulation of the fuel. It is assumed that the increasing degree of the fuel temperature varies in accordance with the fuel remaining amount in the fuel tank. It is assumed that the increasing degree of the fuel temperature in the whole system is relatively small if the fuel remaining amount in the fuel tank is large. It is assumed that the increasing degree of the fuel temperature in the whole system is relatively large if the fuel remaining amount in the fuel tank is small. When the fuel temperature in the whole system is low, only a small problem can be caused even if the fuel temperature rapidly increases during the fuel leak. When the fuel temperature in the whole system is high, the problem of the excessive increase of the fuel temperature over the allowable temperature limit of the fuel injection valve can be caused by the rapid increase of the fuel temperature during the fuel leak.

According to the aspect of the present invention, the heat amount of the leak fuel is restricted in accordance with the fuel remaining amount in the fuel tank. Accordingly, the fuel temperature in the whole system can be brought to relatively low temperature when the fuel remaining amount is small, for example. In this case, the fuel temperature can be suitably managed in consideration of the temperature increase due to the fuel leak in the fuel injection valve. Thus, the problem that the fuel injection amount, the fuel pressure or the like is restricted simply based on the fuel temperature such that the high torque required by the driver cannot be satisfied can be averted. Thus, decrease of engine torque against intention of the driver can be inhibited, while protecting the components such as the fuel injection valve.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Now, an example embodiment of the present invention will be explained in reference to drawings. In the present embodiment, the present invention is embodied as a common rail fuel injection system of a vehicular diesel engine.

Figure 1:
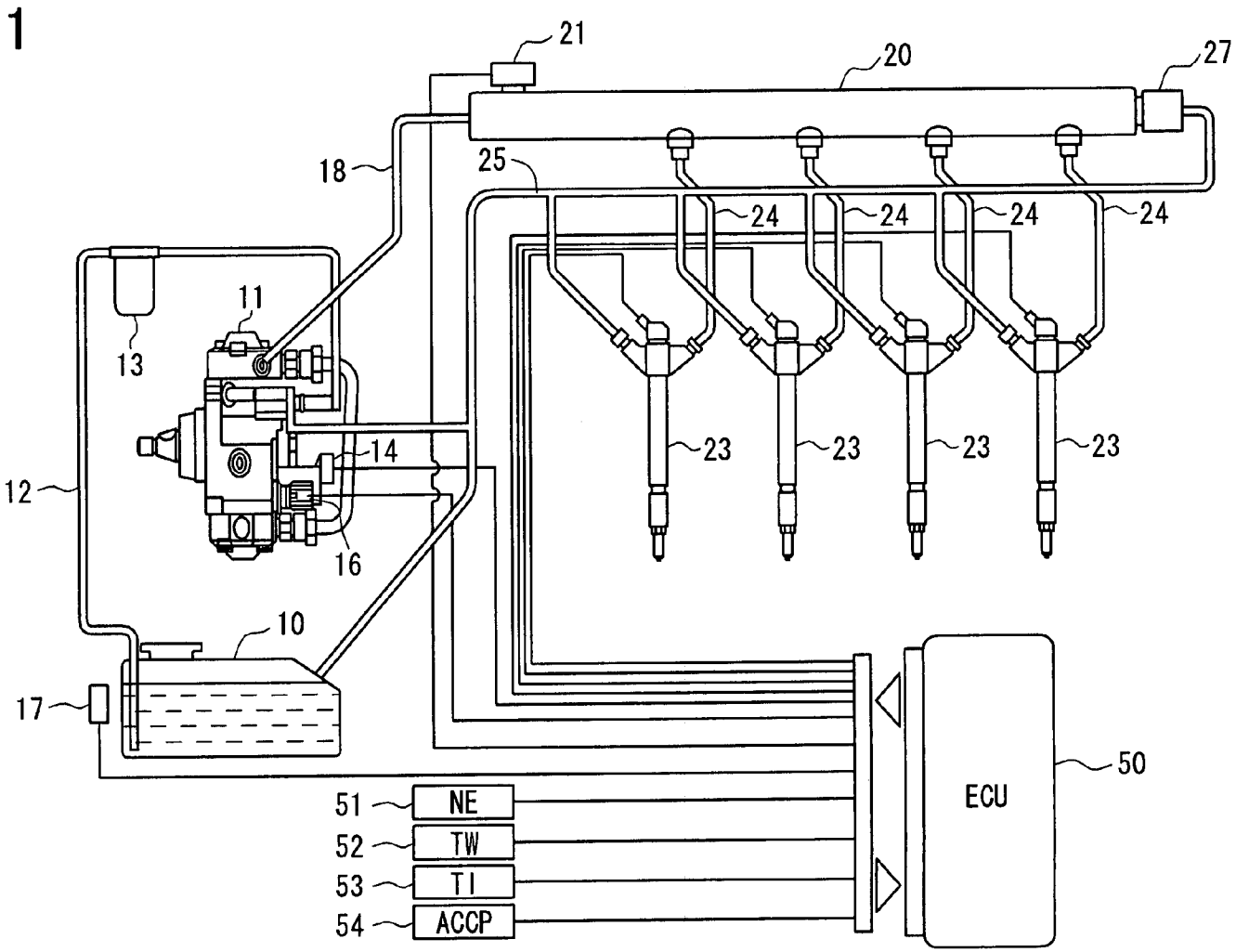
FIG. 1 is a diagram showing a common rail fuel injection system according to an example embodiment of the present invention.

FIG. 1 is a structural diagram showing a common rail fuel injection system. As shown in FIG. 1, a fuel tank 10 is connected with a fuel pump 11 through a fuel pipe 12. The fuel pump 11 is driven by rotation of an engine (not shown) to repeatedly perform suctioning and discharging of fuel. A fuel filter 13 is provided in the fuel pipe 12. An electromagnetic suction metering valve (suction control valve: SCV) 14 is provided in a fuel suctioning section of the fuel pump 11. The low-pressure fuel drawn from the fuel tank 10 is suctioned into a fuel pressurization chamber of the pump 11 through the suction metering valve 14. In the fuel pump 11, a plunger reciprocates in synchronization with the rotation of the engine to pressurize the fuel in the fuel pressurization chamber to high pressure and to discharge the high-pressure fuel. The fuel pump 11 is provided with a fuel temperature sensor 16 for sensing fuel temperature TF in the fuel pump 11. The fuel tank 10 is provided with a remaining amount sensor 17 for sensing a remaining amount RQ of the fuel in the fuel tank 10.

The fuel pump 11 is connected with a common rail 20 through a fuel discharge pipe 18. The high-pressure fuel discharged from the fuel pump 11 is serially supplied to the common rail 20 through the fuel discharge pipe 18. Thus, the fuel in the common rail 20 is maintained in a high-pressure state. The common rail 20 is provided with a fuel pressure sensor 21 for sensing the fuel pressure in the common rail 20 (actual rail pressure P). Alternatively, the fuel pressure P may be estimated based on the engine operation state.

Electromagnetic injectors 23 are provided in cylinders of the engine respectively. The high-pressure fuel is supplied to the injectors 23 through high-pressure fuel pipes 24. The injector 23 is driven to inject and supply the fuel to each cylinder of the engine. Part of the fuel supplied to the injector 23 is returned to the fuel tank 10 through a return pipe 25.

Figure 2:
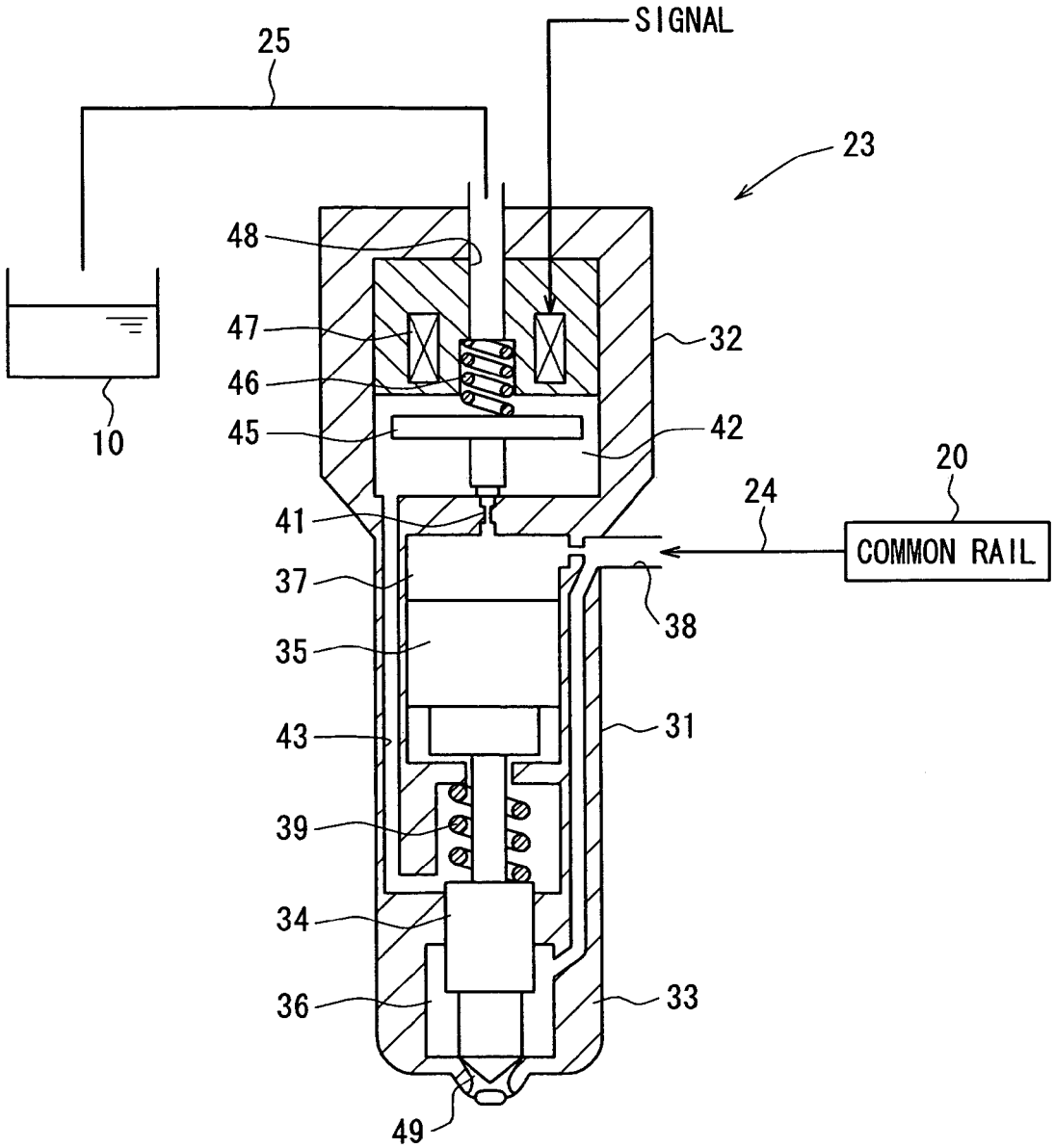
FIG. 2 is a sectional diagram showing an injector according to the FIG. 1 embodiment.

Next, a structure of the injector 23 will be briefly explained in reference to FIG. 2. As shown in FIG. 2, the injector 23 has an injector main body 31 and an electromagnetic drive section 32 provided by a two-way electromagnetic valve. In the injector main body 31, an injection nozzle 34 and a command piston 35 are slidably accommodated in a body 33. The high-pressure fuel is introduced into a fuel sump chamber 36 formed on a tip end side of the injection nozzle 34 and a pressure control chamber 37 formed on a backside (upper side in FIG. 2) of the command piston 35 through the high-pressure fuel pipe 24 and a high-pressure fuel passage 38. In this structure, the injection nozzle 34 and the command piston 35 move in accordance with a balance among pressure in the pressure control chamber 37 (downward force), pressure in the fuel sump chamber 36 (upward force) and a biasing force of a spring 39 biasing the injection nozzle 34 downward.

The pressure control chamber 37 is connected with a low-pressure fuel chamber 42 through an orifice 41. The leak fuel leaking from the fuel sump chamber 36 or the pressure control chamber 37 is introduced into the low-pressure fuel chamber 42 through a leak passage 43. The low-pressure fuel chamber 42 is provided with a valve member 45 for opening and closing an opening of the orifice 41. The valve member 45 is normally biased by a spring 46 in a direction for closing the orifice opening. When an electromagnetic solenoid 47 of the electromagnetic drive section 32 is de-energized, the valve member 45 blocks the orifice opening. If the electromagnetic solenoid 47 is energized by an energization signal transmitted from an electronic control unit (ECU) 50, the valve member 45 moves upward in FIG. 2 to open the orifice opening. Thus, the pressure control chamber 37 communicates with the low-pressure fuel chamber 42. The low-pressure fuel chamber 42 is connected with a return fuel passage 48, which is connected with the return pipe 25.

In this structure, if the electromagnetic solenoid 47 is de-energized, the valve member 45 is positioned in a valve closing position (position for blocking the opening of the orifice 41). Accordingly, an inside of the pressure control chamber 37 is held in a high-pressure state. Thus, as shown in FIG. 2, the injection nozzle 34 blocks a tip end injection hole 49. In this state, the fuel injection is not performed. If the electromagnetic solenoid 47 is energized, the valve member 45 moves to a valve opening position (position for opening the opening of the orifice 41), and the high-pressure fuel in the pressure control chamber 37 flows into the low-pressure fuel chamber 42 through the orifice 41. At that time, the pressure in the pressure control chamber 37 decreases rapidly. Accordingly, the injection nozzle 34 moves upward. Thus, the tip end injection hole 49 opens and the fuel injection is performed. The fuel flowing into the low-pressure chamber 42 is discharged (leaked) into the fuel tank 10 through the return fuel passage 48 and the return pipe 25.

Instead of the two-way valve injector having the electromagnetic drive section 32 provided by the two-way electromagnetic valve, a three-way valve injector having an electromagnetic drive section provided by a three-way electromagnetic valve may be used as the injector 23.

As shown in FIG. 1, the common rail 20 is provided with a mechanical (or electromagnetic) pressure reduction valve 27, which is opened when the common rail pressure P increases excessively. Thus, the high-pressure fuel is returned to the fuel tank 10 through the return pipe 25 to reduce the common rail pressure P.

The ECU 50 is an electronic control unit having a microcomputer of a known structure consisting of CPU, ROM, RAM, EEPROM and the like. Sensing signals are serially inputted into the ECU 50 from various sensors such as the fuel temperature sensor 16, the remaining amount sensor 17, the fuel pressure sensor 21, a rotation speed sensor 51 for sensing rotation speed NE of the engine, a coolant temperature sensor 52 for sensing temperature TW of an engine coolant, an intake temperature sensor 53 for sensing temperature TI of intake air, and an accelerator sensor 54 for sensing an accelerator operation amount ACCP provided by a driver. The ECU 50 decides optimum fuel injection amount and injection timing based on engine operation information such as the engine rotation speed NE and the accelerator operation amount ACCP. The ECU 50 outputs an injection control signal to the injector 23 in accordance with the fuel injection amount and the injection timing. Thus, the fuel injection from the injector 23 into a combustion chamber of each cylinder is controlled.

The ECU 50 calculates a target value Pt of the common rail pressure P (injection pressure) based on the present engine rotation speed NE and fuel injection amount and feedback-controls the fuel discharge amount of the fuel pump 11 to conform the actual rail pressure P to the target rail pressure Pt. Practically, a target discharge amount of the fuel pump 11 is decided based on a deviation between the actual rail pressure P and the target rail pressure Pt and the opening degree of the suction metering valve 14 is controlled in accordance with the target discharge amount. At that time, a command current value (drive current) of an electromagnetic solenoid of the suction metering valve 14 is controlled. Thus, the opening degree of the suction metering valve 14 is increased or decreased, and the fuel discharge amount of the fuel pump 11 is regulated.

In this common rail system, when the injector 23 performs the fuel injection, the high-pressure fuel is leaked to a low-pressure side through the electromagnetic drive section 32 provided in the injector 23. It is assumed that the leak fuel temperature rapidly increases because the high-pressure fuel is depressurized rapidly during the fuel leak. Specifically, it is assumed that the temperature increase as of the fuel leak enlarges as the rail pressure P increases. If the leak fuel temperature increases over a heat-resistant condition of the injector 23, a failure of the injector 23 can be caused.

In the above-described common rail system, the fuel returned to the fuel tank 10 as the leak fuel flows from the fuel pump 11 to the common rail 20, and then, to the injector 23. The repetition of this circulation gradually increases the fuel temperature in the whole system. This can raise the possibility of the increase of the fuel temperature as of the fuel leak over the heat-resistant condition of the injector 23.

It is assumed that the increasing degree of the fuel temperature in the whole system varies in accordance with the remaining amount RQ of the fuel in the fuel tank 10. It is assumed that the increasing degree of the fuel temperature in the whole system is relatively small if the remaining amount RQ of the fuel in the fuel tank 10 is large. It is assumed that the increasing degree of the fuel temperature in the whole system is relatively large if the remaining amount RQ of the fuel in the fuel tank 10 is small. When the fuel temperature in the whole system is low, a problem is not so significant even if the fuel temperature rapidly increases during the fuel leak. When the fuel temperature in the whole system is high, the fuel temperature can exceed an allowable temperature limit of the injector 23 due to the rapid increase of the fuel temperature as of the fuel leak.

Therefore, in the present embodiment, a heat amount of the leak fuel of the injector 23 is restricted based on the remaining amount RQ of the fuel in the fuel tank 10. Through the heat amount restriction, the increase of the fuel temperature in the whole system is inhibited.

Figure 3:
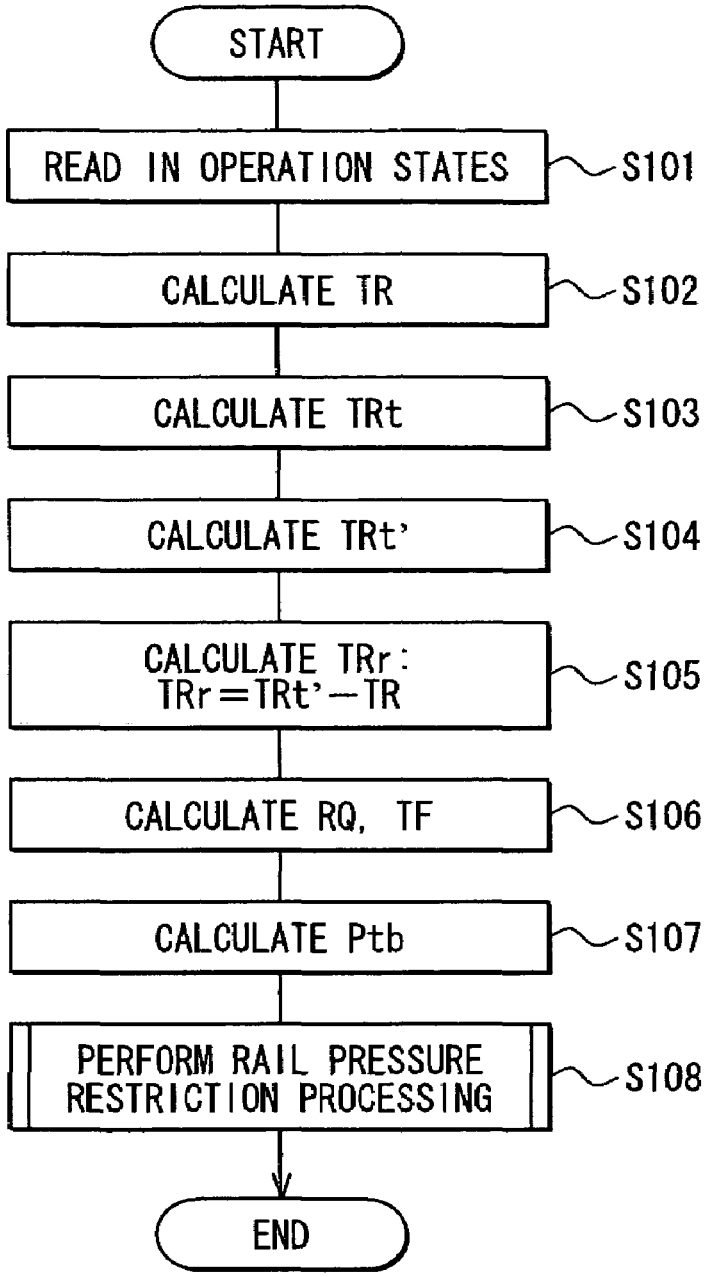
FIG. 3 is a flowchart showing setting processing of target rail pressure according to the FIG. 1 embodiment.

Next, calculation processing regarding the fuel temperature increase restriction performed by the ECU 50 will be explained in detail in reference to drawings including a flowchart. FIG. 3 is a flowchart showing processing for setting the target rail pressure Pt. The ECU 50 repeatedly executes the processing shown in FIG. 3 in a predetermined time cycle. Specifically, the processing includes the fuel temperature increase restriction processing. Pressure reduction correction of the target rail pressure Pt is performed to restrict the temperature increase as of the fuel leak of the injector 23.

In the flowchart shown in FIG. 3, first, Step S101 reads in various parameters indicating the engine operation states. Here, the engine rotation speed NE, the fuel injection amount, the accelerator position ACCP, the actual rail pressure P, the engine coolant temperature TW, the intake temperature TI and the like are read in. Then, Steps S102 to S105 calculate requirement torque TRr required by the driver based on the accelerator position ACCP and the like.

Figure 5:
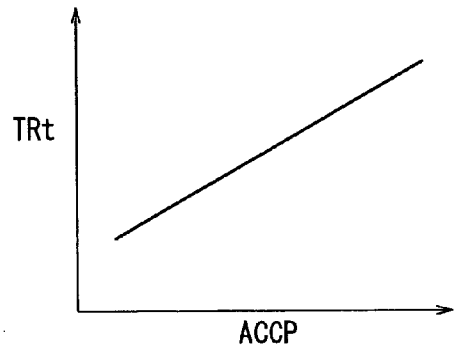
FIG. 5 is a diagram showing a relationship between an accelerator position and target torque according to the FIG. 1 embodiment.

Step S102 calculates present torque TR in reference to a map and the like by using the engine rotation speed NE and the fuel injection amount as main calculation parameters. Step S103 calculates target torque TRt based on the accelerator position ACCP. For example, the target torque TRt is calculated by using a relationship shown in FIG. 5. When the present torque TR is calculated, correction should be preferably performed based on supercharging pressure information of a turbocharger or an EGR ratio (exhaust gas recirculation ratio) of an EGR device. When the target torque TRt is calculated, correction should be preferably performed based on a change amount of the accelerator position ACCP.

Then, Step S104 performs smoothing calculation of the target torque TRt calculated at Step S103 to calculate smoothed target torque TRt'. At that time, the smoothing calculation is performed with a filtering device such as a first-order lag filter or a second-order lag filter. Step S105 calculates the requirement torque TRr by subtracting the present torque TR from the smoothed target torque TRt'.

Then, Step S106 calculates a fuel state parameter regarding the fuel in the fuel tank 10. For example, the remaining amount RQ of the fuel in the fuel tank 10 is calculated based on the sensing signal of the remaining amount sensor 17 and the fuel temperature in the fuel tank 10 is calculated based on the sensing signal of the fuel temperature sensor 16. In the present embodiment, the fuel temperature sensor 16 is provided in the fuel pump 11 to sense the fuel temperature TF in the fuel pump 11. The fuel temperature in the fuel tank 10 is correlated with the fuel temperature TF in the fuel pump 11. Therefore, the fuel temperature in the fuel tank 10 can be calculated from the sensing signal of the fuel temperature sensor 16.

Then, Step S107 calculates a base value Ptb of the target rail pressure Pt based on the engine rotation speed NE and the requirement torque TRr by using a predetermined target rail pressure map. Then, Step S108 performs rail pressure restriction processing to set the target rail pressure Pt.

Next, the rail pressure restriction processing will be explained in reference to a flowchart shown in FIG. 4.

Figure 4:
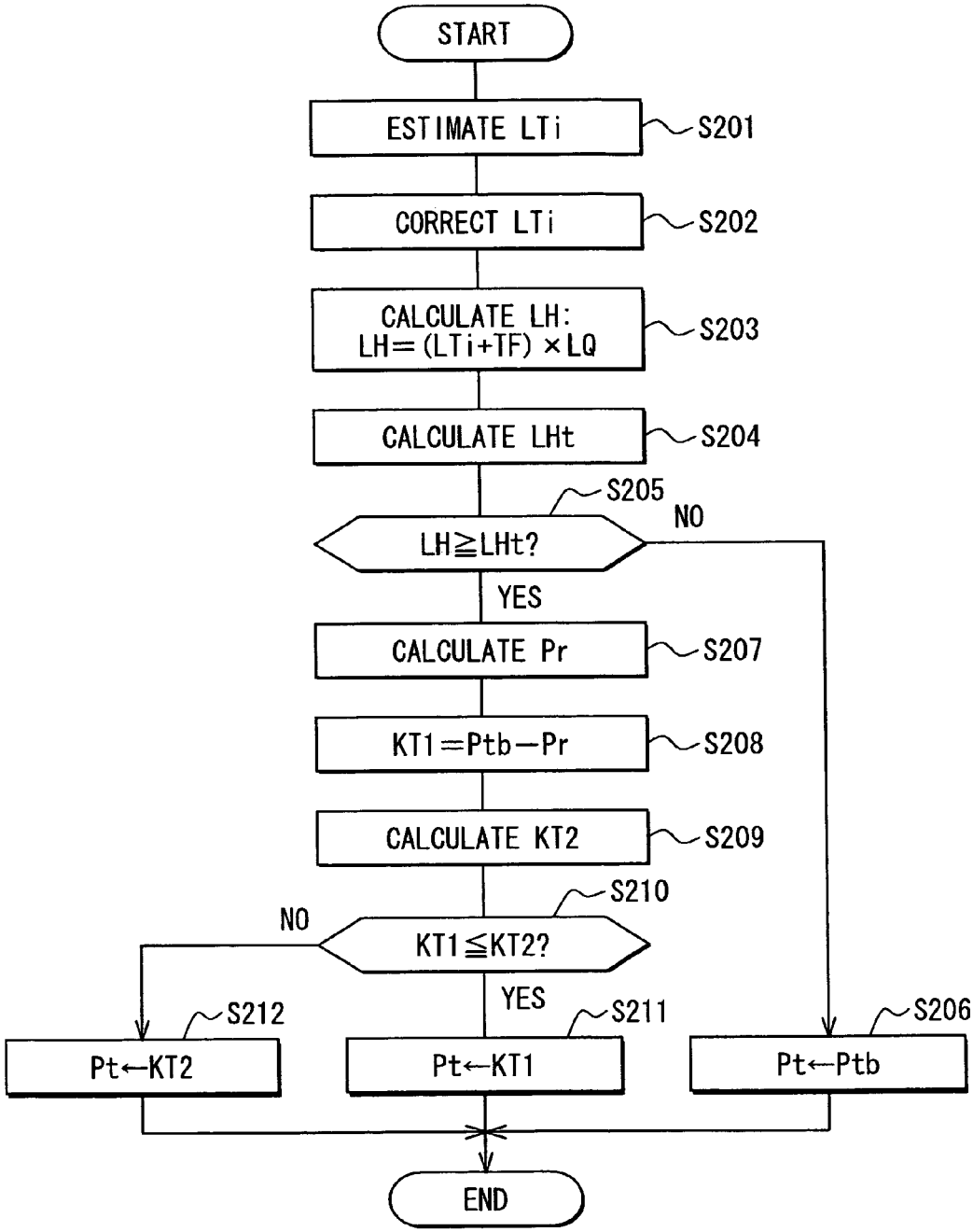
FIG. 4 is a flowchart showing rail pressure restriction processing according to the FIG. 1 embodiment.
Figure 6:
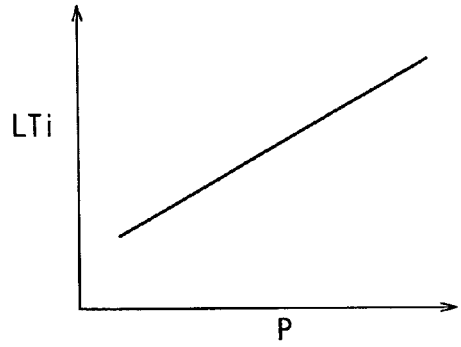
FIG. 6 is a diagram showing a relationship between actual rail pressure and leak temperature increase according to the FIG. 1 embodiment.

Steps S201 to S203 of the flowchart shown in FIG. 4 estimate the heat amount of the leak fuel of the injector 23 (actual leak heat amount LH). More specifically, Step S201 calculates an increase of the fuel temperature (leak temperature increase LTi) accompanying the fuel leak at the injector 23 by using the actual rail pressure P calculated based on the sensing signal of the fuel pressure sensor 21 as a parameter. For example, the leak temperature increase LTi is calculated by using a relationship shown in FIG. 6. According to FIG. 6, higher leak temperature increase LTi is calculated as the actual rail pressure P increases.

Step S202 corrects the leak temperature increase LTi in accordance with the various operation conditions. For example, the engine rotation speed NE, the fuel temperature TF, the fuel injection amount, the engine coolant temperature TW and the intake temperature TI are used as correction parameters, and correction coefficients of the respective correction parameters are calculated. Then, the leak temperature increase LTi is corrected by multiplying the leak temperature increase LTi by the correction coefficients.

Step S203 calculates the actual leak heat amount LH based on the calculated leak temperature increase LTi (corrected leak temperature increase LTi), the present fuel temperature TF and the present leak fuel amount LQ based on a following equation: $LH=(LTi+TF)\times LQ$. The leak fuel amount LQ depends on the fuel injection amount. Therefore, the leak fuel amount LQ is calculated by using the present fuel injection amount as a parameter.

Figure 7:
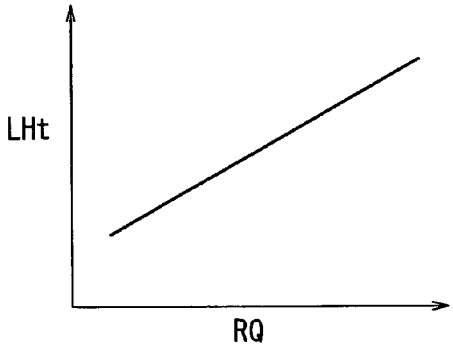
FIG. 7 is a diagram showing a relationship between a fuel remaining amount and a target leak heat amount according to the FIG. 1 embodiment.

Then, Step S204 calculates a target leak heat amount LHt based on the remaining amount RQ of the fuel in the fuel tank 10. For example, the target leak heat amount LHt is calculated by using a relationship shown in FIG. 7. According to FIG. 7, the larger target leak heat amount LHt is calculated as the fuel remaining amount RQ increases. The target leak heat amount LHt corresponds to an allowable heat amount (presently allowed leak fuel heat amount).

Step S205 determines whether the actual leak heat amount LH is "equal to or greater than" the target leak heat amount LHt. If the answer to Step S206 is NO, the process goes to Step S206. Step S206 sets the base value Ptb of the target rail pressure Pt calculated at Step S107 of FIG. 3 as the target rail pressure Pt. In this case, the restriction of the rail pressure P for reducing the temperature of the leak fuel is not performed.

Figure 8:
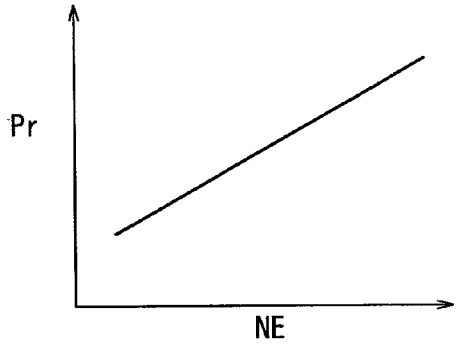
FIG. 8 is a diagram showing a relationship between engine rotation speed and a rail pressure reduction amount according to the FIG. 1 embodiment.

If the answer to Step S205 is YES, the process goes to Step S207. Step S207 calculates a rail pressure reduction amount Pr in a range satisfying the present requirement torque TRr. Then, Step S208 calculates a first restriction rail pressure KT1 by performing correction for reducing the base value Ptb of the target rail pressure Pt with the rail pressure reduction amount Pr based on a following equation: $KT1=Ptb-Pr$. For example, the rail pressure reduction amount Pr is calculated by using a relationship shown in FIG. 8. According to FIG. 8, the larger rail pressure reduction amount Pr is calculated as the engine rotation speed NE increases. Alternatively, the rail pressure reduction amount Pr may be a fixed value.

The base value Ptb of the target rail pressure Pt is calculated based on the engine rotation speed NE and the requirement torque TRr by using map data as described above. The map data include a certain margin with respect to normal requirement torque TRr. Therefore, the requirement torque TRr can be satisfied even if the reducing correction of the target rail pressure Pt is performed by using the rail pressure reduction amount Pr.

Figure 9:
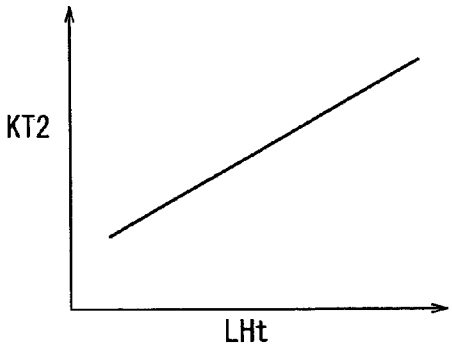
FIG. 9 is a diagram showing a relationship between the target leak heat amount and second restriction rail pressure according to the FIG. 1 embodiment.

Then, Step S209 calculates a second restriction rail pressure KT2 based on the target leak heat amount LHt. For example, the second restriction rail pressure KT2 is calculated by using a relationship shown in FIG. 9. According to FIG. 9, the larger second restriction rail pressure KT2 is calculated as the target leak heat amount LHt increases. The target leak heat amount LHt is calculated by using the remaining amount RQ of the fuel in the fuel tank 10 as the parameter. The second restriction rail pressure KT2 can also be calculated based on the remaining amount RQ of the fuel.

Step S210 determines whether the first restriction rail pressure KT1 is "equal to or less than" the second restriction rail pressure KT2. If the answer to Step S210 is YES, the process goes to Step S211. Step S211 sets the first restriction rail pressure KT1 as the target rail pressure Pt. If the answer to Step S210 is NO, the process goes to Step S212. Step S212 sets the second restriction rail pressure KT2 as the target rail pressure Pt.

Figure 10B:
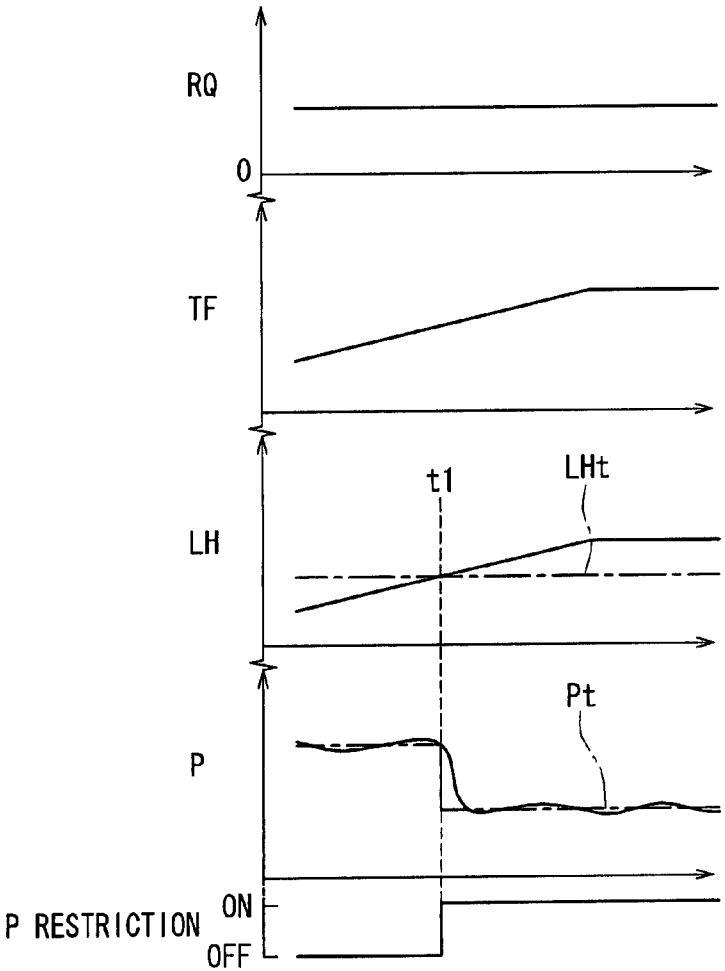
FIGS. 10A and 10B are time charts showing the rail pressure control accompanied by the rail pressure restriction according to the FIG. 1 embodiment.
Figure 10A:
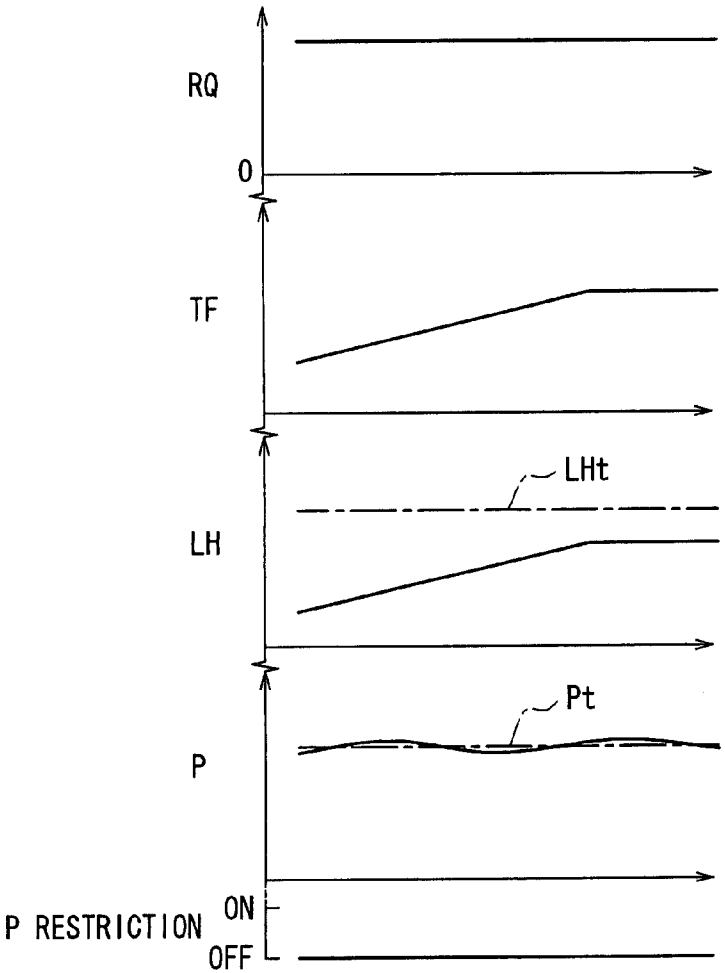

Next, rail pressure control accompanied by the above-described rail pressure restriction will be explained in detail in reference to time charts shown in FIGS. 10A and 10B. FIG. 10A shows an example in which the remaining amount RQ of the fuel in the fuel tank 10 is relatively large. FIG. 10B shows an example in which the remaining amount RQ of the fuel in the fuel tank 10 is relatively small. In the examples shown in FIGS. 10A and 10B, it is assumed that the fuel temperature (fuel temperature TF in the pump 11) increases due to the heat radiation of the engine. Correspondingly, the actual leak heat amount LH increases in both cases shown in FIGS. 10A and 10B. In both examples, it is assumed that the engine operation state is stabilized and the base value Ptb of the target rail pressure Pt is substantially constant. Accordingly, the actual rail pressure P is substantially constant in both cases.

In the case of FIG. 10A, the target leak heat amount LHt is large since the fuel remaining amount RQ is large. The actual leak heat amount LH does not exceed the target leak heat amount LHt. Therefore, the rail pressure restriction is not performed.

In the case of FIG. 10B, the target leak heat amount LHt is small since the remaining amount RQ of the fuel is small. The actual leak heat amount LH becomes equal to or greater than the target leak heat amount LHt at timing t1. Therefore, the rail pressure restriction is performed by changing the target rail pressure Pt to a lower value since the timing t1. Since the actual rail pressure P is reduced by the rail pressure restriction, the temperature increase as of the fuel leak at the injector 23 is restricted. The increase of the fuel temperature in the fuel tank 10 is inhibited and the fuel temperature in the whole system is reduced.

More specifically, the first and second restriction rail pressures KT1, KT2 are calculated and the smaller one out of the first and second restriction rail pressures KT1, KT2 is set as the target rail pressure Pt since the timing t1.

The present embodiment exerts following excellent effects.

The heat amount of the leak fuel of the injector 23 is restricted based on the remaining fuel amount in the fuel tank 10. Therefore, the fuel temperature in the whole system can be relatively decreased when the fuel remaining amount RQ is small. In this case, the fuel temperature can be managed appropriately in consideration of the temperature increase accompanying the fuel leak at the injector 23. Thus, the problem that the high requirement torque TRr required by the driver is not satisfied when the fuel injection amount, the fuel pressure and the like are restricted simply based on the fuel temperature can be averted. Thus, the problem of reduction of the torque of the engine against intention of the driver can be averted while protecting the injector 23 and the like. In the above-described structure, there is no need to provide an additional fuel cooler for reducing the fuel temperature. Thus, complication of the structure or cost increase can be averted.

The rail pressure restriction is performed as a method of restricting the heat amount LH of the leak fuel. Thus, the actual rail pressure P is reduced and the temperature increase of the leak fuel is reduced when the high-pressure fuel leaks from the injector 23. As a result, the increase of the fuel temperature in the whole system is inhibited. Thus, the injector 23 and the like can be suitably protected.

In the rail pressure restriction, the first restriction rail pressure KT1 is calculated by performing the reducing correction of the base value Ptb of the target rail pressure Pt with the rail pressure reduction amount Pr. The second restriction rail pressure KT2 is calculated based on the target leak heat amount LHt (parameter correlated with the fuel remaining amount RQ). The smaller one out of the first and second restriction rail pressures KT1, KT2 is used as the target rail pressure Pt. Thus, the actual rail pressure P can be surely reduced.

The actual leak heat amount LH of the injector 23 is estimated and the target leak heat amount LHt as the allowable heat amount is calculated from the fuel remaining amount RQ in the fuel tank 10. If the actual leak heat amount LH is equal to or greater than the target leak heat amount LHt, the heat amount restriction of the leak fuel (rail pressure restriction) of the injector 23 is performed. Thus, the heat amount restriction of the leak fuel (rail pressure restriction) can be performed at desirable timing. Thus, the fuel temperature in the system can be suitably managed.

The above-described embodiment may be modified as follows.

In the rail pressure restriction according to the above-described embodiment, the first restriction rail pressure KT1 is calculated by performing the reducing correction of the base value Ptb of the target rail pressure Pt with the rail pressure reduction amount Pr, and the second restriction rail pressure KT2 is calculated based on the target leak heat amount LHt (parameter correlated with the fuel remaining amount RQ). The smaller one out of the first and second restriction rail pressures KT1, KT2 is used as the target rail pressure Pt. Alternatively, either one of the first restriction rail pressure KT1 and the second restriction rail pressure KT2 may be calculated in the rail pressure restriction and used as the target rail pressure Pt in the rail pressure restriction. Also in this case, the actual rail pressure P can be reduced.

Rail pressure restriction processing based on the fuel temperature TF may be performed when the target rail pressure Pt is set. More specifically, processing of a flowchart shown in FIG. 11 may be performed. The processing shown in FIG. 11 may be performed additionally after the end of the processing shown in FIG. 4 or may be performed in place of the rail pressure restriction processing explained in reference to FIG. 4.

Figure 12:
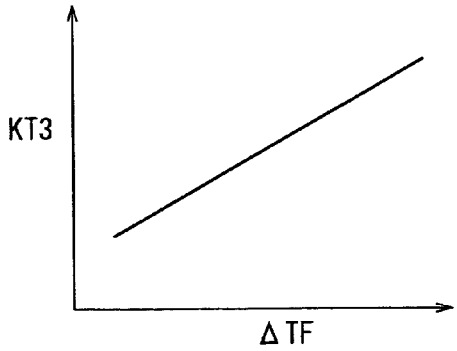
FIG. 12 is a diagram showing a relationship between third restriction rail pressure and temperature difference between fuel temperature and an upper limit value of the fuel temperature of the modified example of the FIG. 1 embodiment.
Figure 11:
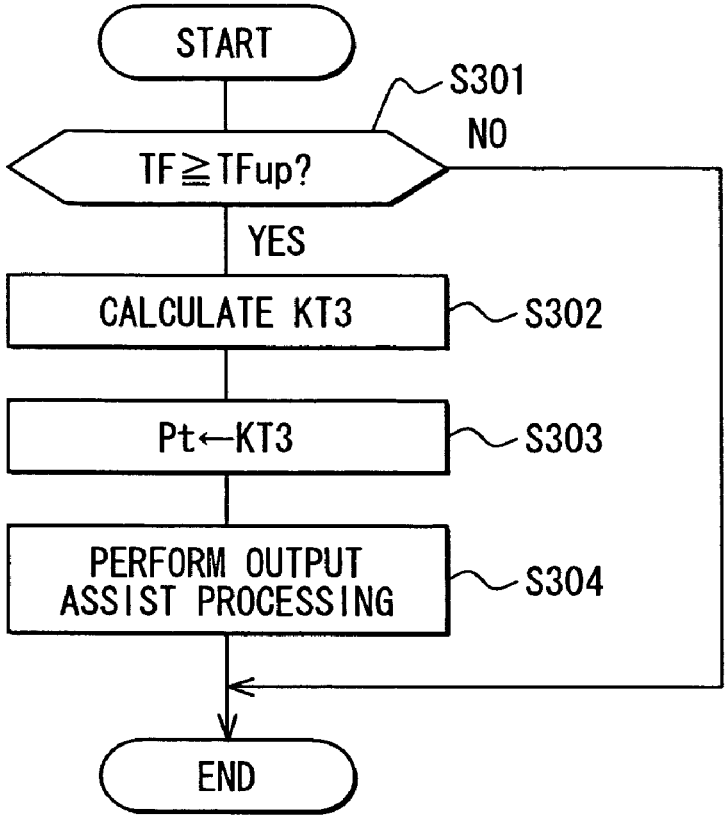
FIG. 11 is a flowchart showing rail pressure restriction processing of a modified example of the FIG. 1 embodiment.

In FIG. 11, Step S301 determines whether the fuel temperature TF sensed through the sensing signal of the fuel temperature sensor 16 is "equal to or higher than" a predetermined upper limit value TFup (for example, 90° C.). If the answer to Step S301 is NO, the processing is ended immediately. If the answer to Step S301 is YES, the process goes to Step S302. Step S302 calculates a temperature difference ΔTF between the present fuel temperature TF and the upper limit value TFup and calculates a third restriction rail pressure KT3 based on the temperature difference ΔTF. For example, the third restriction rail pressure KT3 is calculated by using a relationship shown in FIG. 12. According to FIG. 12, the larger third restriction rail pressure KT3 is calculated as the temperature difference ΔTF increases. The third restriction rail pressure KT3 calculated based on the relationship shown in FIG. 12 is generally smaller than either one of the first and second restriction rail pressures KT1, KT2.

Then, Step S303 sets the third restriction rail pressure KT3 as the target rail pressure Pt. Step S304 restricts operation states of accessories linked to and driven by the engine as output assist processing for assisting the engine output. More specifically, the accessories include an alternator or a compressor of an air conditioner. As for the alternator, power generation is restricted to restrict the operation state of the alternator. As for the compressor, compressor rotation speed is restricted to restrict the operation state of the compressor.

According to the processing shown in FIG. 11, suitable rail pressure restriction can be performed when the fuel temperature TF increases excessively. Since the operation states of the accessories are restricted during the rail pressure restriction, the load of the engine can be reduced to increase the torque. More preferably, the operation states of the accessories should be restricted under a condition that it is determined that the requirement torque TRr cannot be satisfied due to the rail pressure restriction.

The operation restriction of the accessories during the rail pressure restriction may be performed in the processing shown in FIG. 4 in addition to the processing shown in FIG. 11.

When the rail pressure restriction is performed, the fuel injection period of the injector 23 may be changed to be longer. That is, the engine operation state set based on the engine rotation speed NE and the like may be corrected with a period correction value calculated based on the present restriction rail pressure, and the fuel injection may be performed for the corrected fuel injection period. In this case, the actual fuel injection amount can be maintained by extending the fuel injection period even if the rail pressure P is restricted. Thus, the leak heat amount LH can be restricted while maintaining (without changing) the generation torque TR of the engine. The extension of the fuel injection period should be preferably performed when the requirement torque TRr is equal to or greater than a predetermined value.

The rail pressure restriction may be prohibited when the accelerator operation amount ACCP calculated based on the sensing signal of the accelerator sensor 54 is equal to or greater than a certain value or if a change amount for increasing the accelerator operation amount ACCP is equal to or greater than a given value. It is assumed that the driver requires high-speed drive or quick acceleration when the accelerator operation amount ACCP is equal to or greater than the certain value or if the change amount for increasing the accelerator operation amount ACCP is equal to or greater than the given value. In such a case, the requirement of the acceleration by the driver is prioritized. Thus, desired torque response can be realized.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A controller of a pressure accumulation fuel system having a pressure accumulation vessel for accumulating fuel at high pressure corresponding to injection pressure, a fuel supply pump for pressurizing the fuel in a fuel tank to the high pressure and for pressure-feeding the fuel to the pressure accumulation vessel, and a fuel injection valve for injecting the high-pressure fuel supplied from the pressure accumulation vessel to an engine and for leaking part of the high-pressure fuel, the pressure accumulation fuel system returning the leak fuel leaking from the fuel injection valve to the fuel tank, the controller comprising:

a remaining amount sensing device that senses a remaining amount of the fuel in the fuel tank; and a heat amount restricting device that restricts a heat amount of the leak fuel of the fuel injection valve based on the fuel remaining amount sensed by the remaining amount sensing device.

2. The controller as in claim 1, further comprising:

an actual leak heat amount estimating device that estimates an actual leak heat amount generated during the fuel leak of the fuel injection valve; and an allowable heat amount calculating device that calculates a present allowable leak heat amount based on the fuel remaining amount sensed by the remaining amount sensing device, wherein the heat amount restricting device performs the restriction of the heat amount of the leak fuel of the fuel injection valve if the actual leak heat amount estimated by the actual leak heat amount estimating device is greater than the allowable leak heat amount calculated by the allowable heat amount calculating device.

3. The controller as in claim 2, wherein the actual leak heat amount estimating device estimates the actual leak heat amount based on the present fuel pressure in the pressure accumulation vessel and fuel temperature.

4. The controller as in claim 3, wherein the actual leak heat amount estimating device uses engine rotation speed or a fuel injection amount as a parameter for estimating the actual leak heat amount.

5. The controller as in claim 1, wherein the heat amount restricting device changes a target value of the fuel pressure in the pressure accumulation vessel to a lower value and restricts the fuel pressure with the changed target value.

6. The controller as in claim 5, further comprising:

a target value setting device that sets the target value of the fuel pressure in the pressure accumulation vessel based on an engine operation state, wherein the heat amount restricting device corrects the target value of the fuel pressure set by the target value setting device to the lower value.

7. The controller as in claim 5, wherein the target value of the fuel pressure is changed to the lower value with a changing value set in accordance with engine rotation speed.

8. The controller as in claim 5, wherein the heat amount restricting device sets the target value of the fuel pressure in the pressure accumulation vessel based on the fuel remaining amount in the fuel tank or a parameter correlated with the fuel remaining amount and restricts the fuel pressure with the target value.

9. The controller as in claim 5, wherein the fuel injection valve is operated for an extended fuel injection period when the restriction of the fuel pressure in the pressure accumulation vessel is performed.

10. The controller as in claim 5, further comprising:

an accelerator operation amount sensing device that senses an accelerator operation amount provided by a driver; and a prohibiting device that prohibits the restriction of the fuel pressure if the accelerator operation amount is equal to or greater than a predetermined value or a change amount for increasing the accelerator operation amount is equal to or greater than a certain value.

11. The controller as in claim 5, wherein the controller restricts an operation state of an accessory linked with and driven by the engine when the restriction of the fuel pressure in the pressure accumulation vessel is performed.

* * * * *